US010549283B2

(12) United States Patent
Sjobeck et al.

(10) Patent No.: US 10,549,283 B2
(45) Date of Patent: Feb. 4, 2020

(54) JAW CRUSHER RETRACTION ASSEMBLY

(71) Applicant: SANDVIK INTELLECTUAL PROPERTY AB, Sandviken (SE)

(72) Inventors: Roger Sjobeck, Malmo (SE); Marten Lindberg, Malmo (SE)

(73) Assignee: SANDVIK INTELLECTUAL PROPERTY AB, Sandviken (SE)

( * ) Notice: Subject to any disclaimer, the term of this patent is extended or adjusted under 35 U.S.C. 154(b) by 0 days.

(21) Appl. No.: 16/471,951

(22) PCT Filed: Dec. 21, 2016

(86) PCT No.: PCT/EP2016/082228

§ 371 (c)(1),
(2) Date: Jun. 20, 2019

(87) PCT Pub. No.: WO2018/113958

PCT Pub. Date: Jun. 28, 2018

(65) Prior Publication Data

US 2019/0308196 A1 Oct. 10, 2019

(51) Int. Cl.
*B02C 1/02* (2006.01)
*B02C 1/04* (2006.01)

(52) U.S. Cl.
CPC ..... *B02C 1/04* (2013.01)

(58) Field of Classification Search
CPC ..... B02C 1/00–12
USPC ..... 241/262–269
See application file for complete search history.

(56) References Cited

U.S. PATENT DOCUMENTS 1,491,430 A * 4/1924 Stebbins ..... B02C 1/043 241/266
1,972,096 A * 9/1934 Guest ..... B02C 1/025 241/289
2,131,801 A * 10/1938 Gruender ..... B02C 1/06 241/140
2,598,942 A * 6/1952 Rumpel ..... B02C 1/04 241/217
2,921,750 A * 1/1960 Picalarga ..... B02C 1/04 241/267
3,153,512 A * 10/1964 Polzin ..... B02C 1/10 241/300
3,318,540 A * 5/1967 Gilbert ..... B02C 1/02 241/217
4,509,699 A * 4/1985 Tanaka ..... B02C 1/10 241/268
5,799,888 A * 9/1998 Hamaguchi ..... B02C 1/025 241/259.1

(Continued)

FOREIGN PATENT DOCUMENTS

EP 1190722 A1 3/2002
GB 812507 A 4/1959
WO 2014075722 A1 5/2014

*Primary Examiner* — Adam J Eiseman
*Assistant Examiner* — Bobby Yeonjin Kim
(74) *Attorney, Agent, or Firm* — Corinne R. Gorski

(57) ABSTRACT

A jaw crusher retraction assembly having a base, a first and second mount boss, a resiliently biased component and an actuating cylinder. The cylinder and resiliently biased component are mounted axially between respective regions of the base and the first and second bosses so as to minimize stress in the retraction assembly components and to provide a compact overall design.

14 Claims, 6 Drawing Sheets

(56) References Cited

U.S. PATENT DOCUMENTS

| | | | | |
|---|---|---|---|---|
| 6,116,530 | A * | 9/2000 | Altmayer | B02C 1/025 241/264 |
| 6,375,105 | B1 | 4/2002 | Haven | |
| 7,344,097 | B2 * | 3/2008 | Young | B02C 1/025 241/268 |
| 8,905,337 | B2 * | 12/2014 | Eriksson | B02C 1/025 241/268 |
| 2009/0308961 | A1 * | 12/2009 | Nelson | B02C 15/04 241/121 |
| 2016/0303569 | A1 * | 10/2016 | Jokiranta | B02C 1/02 |

* cited by examiner

JAW CRUSHER RETRACTION ASSEMBLY

RELATED APPLICATION DATA

This application is a § 371 National Stage Application of PCT International Application No. PCT/EP2016/082228 filed Dec. 21, 2016.

FIELD OF INVENTION

The present invention relates to a jaw crusher retraction assembly to form part of a mechanically actuated link assembly for the supported oscillating movement of a movable jaw of a jaw crusher and in particular, although not exclusively, to a retraction assembly to provide controlled axial compression of parts of the link assembly.

BACKGROUND ART

Jaw crushers typically comprise a fixed jaw and a movable jaw that together define a crushing zone. A drive mechanism is operative to rock the movable jaw back and forth in order to crush material within this zone. The crushing zone is generally convergent towards its lower discharge end so that crushable material, fed to an upper and wider end of the zone, is capable of falling downward under gravity whilst being subject to repeated cycles of crushing movement in response to the cyclical motion of the movable jaw. The crushed material is then discharged under gravity through the lower and narrower discharge end onto a conveyor for onward processing or a stockpiling.

Commonly, the frame that supports the fixed jaw is referred to as the front frame end and the movable jaw is connected to what is typically referred to as a back-frame-end via a mechanically actuated link mechanism that serves to control and stabilise the oscillating movement of the movable jaw relative to the stationary jaw. Typically, the link mechanism is both statically and dynamically linearly adjustable to control the grade or size of the resultant crushed material and to facilitate absorption of the impact forces generated by the crushing action.

As will be appreciated, the mechanically actuated link mechanism typically comprises a toggle assembly having a toggle plate that may be positionally supported by wedges, shims or powered cylinders. The toggle assembly is typically held under axial compression when supporting the movable jaw by a retraction or tension assembly mounted to a lower region of the movable jaw and the back-frame-end. Example jaw crushers comprising linkage assemblies to support the movable jaw are described in U.S. Pat. No. 5,799,888; EP 1190722 and U.S. Pat. No. 6,375,105.

However, conventional retraction assemblies are disadvantageous for a number of reasons. In particular, the pivot mountings of the retraction rods and the cylinder are subject to accelerated wear due to the continued transmission of loading forces and torque. Additionally, the combined axial length of existing linkage assemblies is often difficult to accommodate within the limited space available at the lower, rear region of the crusher which creates problems when it is required to mount the crusher within confined spaces. Accordingly, what is required is jaw mounting assembly that addresses these problems.

SUMMARY OF THE INVENTION

It is an objective of the present invention to provide a retraction assembly or system for a jaw crusher that is mechanically robust and configured to minimise stress and loading forces on various components of the assembly so as to extend the operational lifetime of the crusher component parts. It is a further specific objective to provide a compact movable jaw mounting assembly to facilitate mounting of a jaw crusher within confined or otherwise obstructed locations. It is a yet further objective to provide a retraction assembly that is compatible for use with both wedge and shim settings and to avoid the requirement to modify the retraction assembly significantly between wedge and shim setting changes.

The objectives are achieved by a retraction assembly that minimise torque resultant from the relative positioning of the retraction assembly component parts and in particular the spatial separation distance between selected components of the assembly relative to the pivoted mounting position of the assembly at the lower end of the movable jaw. In particular, according to the subject invention, a cylinder that forms part of the assembly, is positioned specifically in the axial direction as close as possible to the lower region of the movable jaw. Accordingly, the contribution to the torque resultant from the mass of the cylinder is reduced which in turn reduces the stress and wear of the various components of the assembly including the cylinder, the pivot mounts and other mounting regions and components. Additionally, due to the relative positioning of the cylinder via a first and second mounting boss, the total axial length of the retraction assembly is minimised without compromising the function and performance of the assembly to control and stabilise the toggle unit, the oscillating movement of the movable jaw and potentially the control of the close side setting (CSS). In particular, the present retraction assembly comprises a compact design and is generally shorter in total length relative to conventional arrangements. Accordingly, the present assembly is capable of being contained within the overall footprint the jaw crusher and does not protrude at least excessively at the lower and rear region of the jaw crusher which is otherwise a feature of conventional retraction assemblies.

The present invention is advantageous to maximise the service lifetime of the component parts of the assembly via the relative positioning of selected components and does not require exclusive or sophisticated component parts to achieve a robust and compact constructions.

According to a first aspect of the present invention there is provided a jaw crusher retraction assembly comprising: a base mountable to a frame part of a jaw crusher; a first boss separated from the base and a second boss separated from the first boss, the second boss positionable furthest from a movable jaw of the jaw crusher relative to the first boss and the base; at least one resiliently biased component mounted to extend between and to resiliently bias separation of the first boss and the base; a first and second retraction rod mounted at respective first ends to the second boss and extending past the first boss and the base for attachment at each respective second ends to the movable jaw; a cylinder having a barrel, a cylinder rod and a piston mounted to couple and act between the first boss and second boss; characterised in that: the barrel is mounted to extend from the first boss in a direction towards the base and one end of the piston rod is positioned at the second boss such that the piston rod extends from the barrel and between the first boss and the second boss.

Reference within this specification to a cylinder encompasses a mechanical, and in particular, a hydraulic or pneumatic linear actuator. This term also encompasses a ram, jack or piston in which a rod is linearly extendable and retractable at a barrel via an internally mounted shuttle (or piston head).

Preferably, the resiliently biased component comprises a spring. More preferably, the resiliently biased component comprises a pair of springs each spring extending between the base and the first boss. Optionally, the retraction assembly may comprise a single spring or a plurality of springs. The springs may comprise different cross sectional profiles including circular or polygonal. Optionally, the resiliently biased component may comprise a resiliently deformable polymeric material such as an elastomer or the like. Preferably, the spring comprises a coil spring having helical turns extending around and defining an axially extending bore. Preferably, a diameter of the internal bore of the coil spring is greater than an external diameter of each retraction rod so as to allow a rod to extend within the bore. Preferably, each of the pair of springs comprises a coil spring that extends respectively around a portion of the length of the respective first and second retraction rods.

Preferably, the coil springs are positioned side-by-side and the barrel is mounted at the first boss to be positioned laterally between the coil springs. Such an arrangement is advantageous to provide a common mount for the coil springs to reduce the overall weight of the assembly and to provide a compact construction.

Optionally, an axial length of the springs is approximately equal to an axial length of the barrel. Optionally, the cylinder may comprise an axial length being greater or less than the springs.

Optionally, the base may be a single component or may be divided into two parts, a first half to mount and positionally support a first retraction rod and spring assembly and a second half configured to mount and support the alternate retraction rod and spring assembly. Preferably, each half is mounted side-by-side at each retraction rod and is separated in the lateral direction (perpendicular to an axial length of the retraction assembly) by a small separation distance. Preferably, the small separation distance is greater than a diameter of the barrel of the cylinder. Preferably, the cylinder barrel extends between the first and second half of the base in the lateral sideways direction perpendicular to the longitudinal axis of the retraction assembly. Such an arrangement is advantageous to provide a compact design, to minimise the weight of the assembly and to at least partially protect the cylinder in mounted position. Additionally, the present invention greatly facilitates the mounting, attachment and maintenance of hoses etc., associated with the back frame end and in particular the pneumatic and/or hydraulic systems at this region of the crusher.

Preferably, each of the first and second boss comprise a plate-like structure. Preferably, the first boss is larger than the second boss in respective planes aligned perpendicular to the longitudinal axis of the assembly. The first boss comprising a larger surface area is advantageous to mount the coil springs and the intermediate positioned cylinder barrel. Preferably, a diameter of the coil springs is greater than a diameter of the cylinder barrel.

Preferably, the first boss comprises first boss apertures and the first and second retraction rods pass respectively through the first boss apertures. Preferably, the base comprises base apertures, the first and second retraction rods passing respectively through the base apertures. Such an arrangement is advantageous to provide a compact design and also to assist with stabilisation of the retraction rods in a direction away from their pivotally mounted end at the lower region of the movable jaw.

Preferably, the barrel comprises a first and a second end, the cylinder mounted at the first boss at the first end of the barrel. Preferably, the full length of the barrel extends from one side of the first boss. Accordingly, the entire mass of the barrel is mounted from the first boss and is positioned towards the first end of the retraction rods mounted at the movable jaw. Such a configuration minimises torque at the rod pivot mountings (at their junction with the movable jaw) by minimising the axial separation of the mass of the cylinder barrel and accordingly the cylinder piston from the pivot mountings. In particular, this is advantageous to reduce the loading forces at the pivot mountings when the jaw is stationary or is moving dynamically. When the jaw is oscillating, the present retraction assembly is beneficial to minimise any inertia created by the oscillating movement of the retraction assembly and in particular the cylinder barrel and piston.

Preferably, the full length of the cylinder rod extends from one side of the second boss. Such a configuration minimises the total axial length of the assembly and also minimises torque at the opposite end of the retraction rods mounted at the movable jaw.

According to a second aspect of the present invention there is provided a jaw crusher comprising: a first jaw and a second movable jaw; a jaw mounting assembly to enable the movable jaw to oscillate back and forth relative to the first jaw; characterised in that: the jaw mounting assembly comprises a jaw retraction assembly as described and claimed herein.

Preferably, the jaw mounting assembly comprises a back-frame-end and the base is mounted to an underside region of the back-frame-end. Preferably, the retraction assembly is mounted directly to the back-frame-end via a releasable attachments, such as bolts, screws or the like.

BRIEF DESCRIPTION OF DRAWINGS

A specific implementation of the present invention will now be described, by way of example only, and with reference to the accompanying drawings in which.

DETAILED DESCRIPTION OF PREFERRED EMBODIMENT OF THE INVENTION

Figure 1:
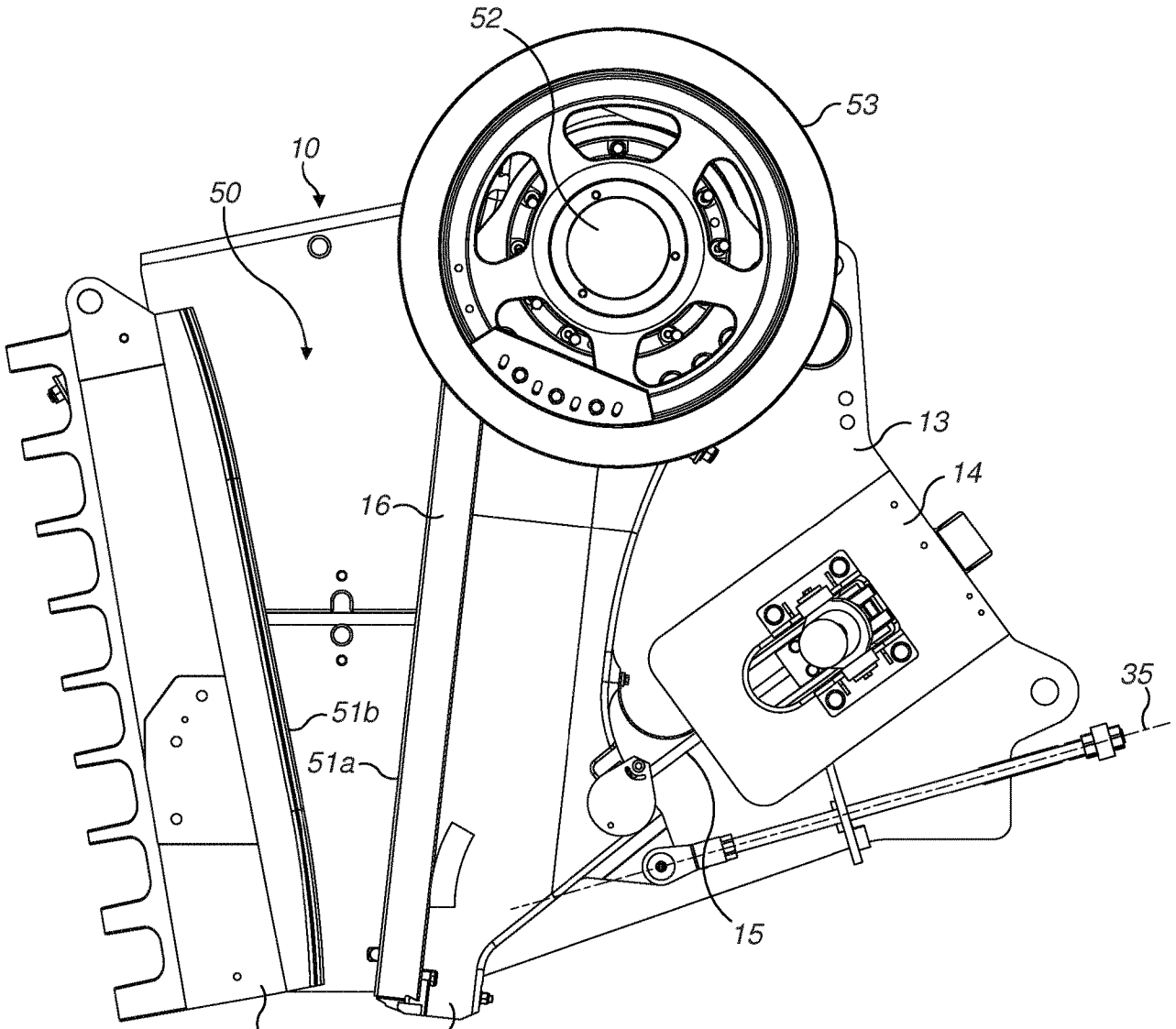
FIG. 1 is a perspective side view of a jaw crusher having a sidewall removed for illustrative purposes comprising a mechanically actuated link mechanism to support a movable jaw according to a specific implementation of the present invention.

Referring to FIG. 1, a jaw crusher 10 comprises a first stationary jaw 11 and a second movable jaw 12. Each jaw mounts a respective jaw plate 51*a*, 51*b* in opposed relationship to define a crushing zone 50 extending lengthwise between the stationary and movable jaws 11, 12. Movable jaw 12 is mounted and suspended towards its upper end via a shaft (not shown) having axial ends covered by respective end caps 52. A pair of flywheels 53 communicate rotational drive to the shaft to impart an oscillating gyroscopic motion to movable jaw 12 to increase and decrease the volume of the crushing zone 50 and accordingly crush material introduced into the zone 50 between the plates 51*a*, 51*b*.

The oscillating motion of movable jaw 12 is stabilised by a mechanically actuated link assembly provided at a lower, rear region of the jaw crusher 10. The actuated link assembly comprises a toggle unit 15 coupled between a lower part of movable jaw 12 and a back-frame-end 14. Back-frame-end 14 is supported and mounted in position between a pair of sidewalls 13 that extend either side and between jaws 11 and 12 that, in part, define the crushing chamber 50 of jaw crusher 10. According to the specific implementation, jaw crusher 10 is implemented in wedge configuration (but could equally be shim configuration), with the wedge assembly acting on toggle unit 15 so as to be capable of dynamically adjusting and controlling the reciprocating motion of movable jaw 12 to and from stationary jaw 11. Crusher 10 further comprises a retraction assembly indicated generally by reference 16 configured to provide a compressive force onto the axial length of toggle unit 15 between back-frame-end 14 and movable jaw 12. Retraction assembly 16 comprises an axial length extending on axis 35 so as to project rearwardly away from movable jaw 12 and below the back-frame-end 14.

Figure 2:
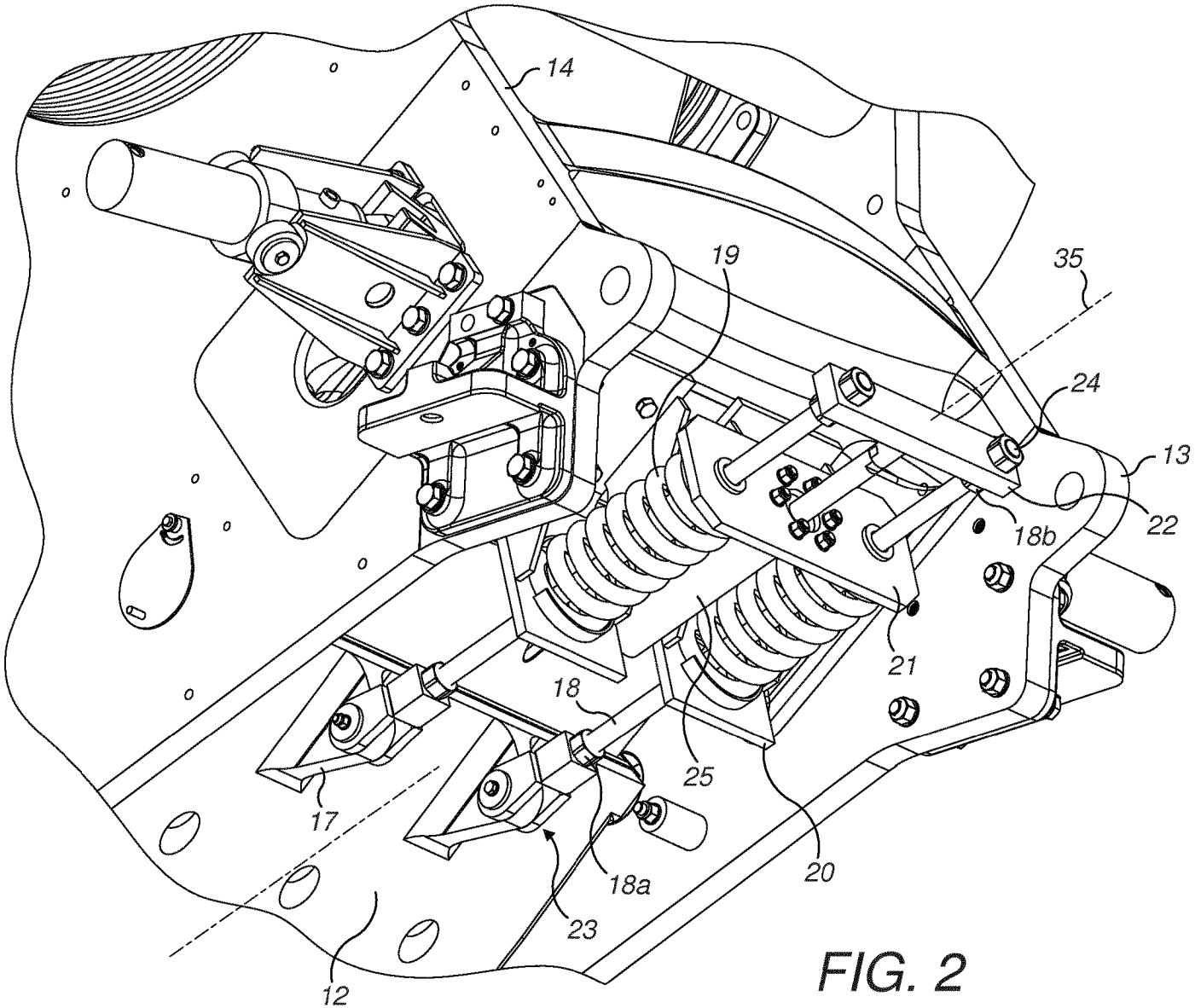
FIG. 2 is an underside perspective view of the jaw crusher of FIG. 1 illustrating a retraction assembly according to a specific implementation of the present invention with the selected component removed for illustrative purposes.
Figure 3:
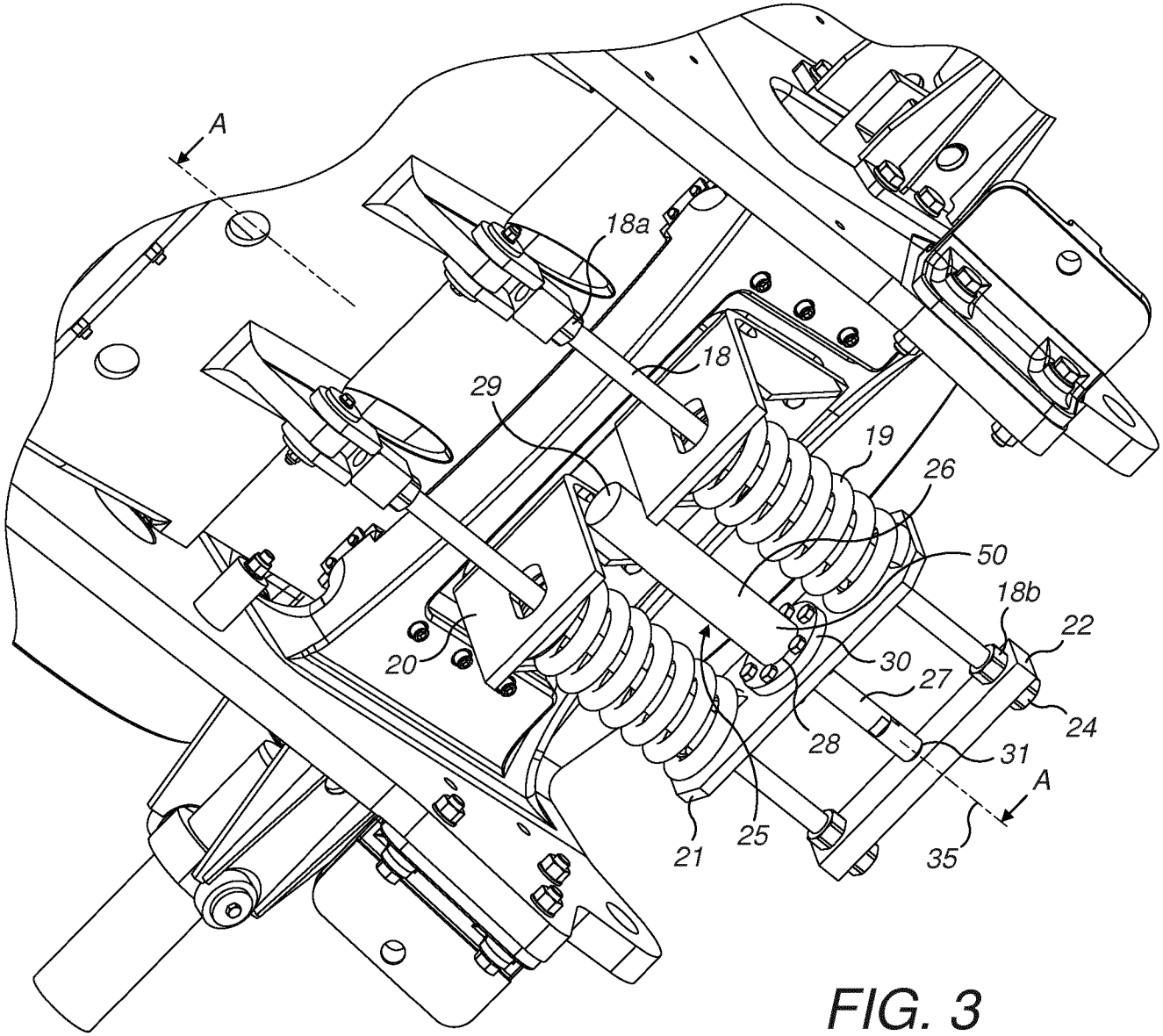
FIG. 3 is a further underside perspective view of the retraction assembly of FIG. 2 with selected components removed for illustrative purposes.
Figure 4:
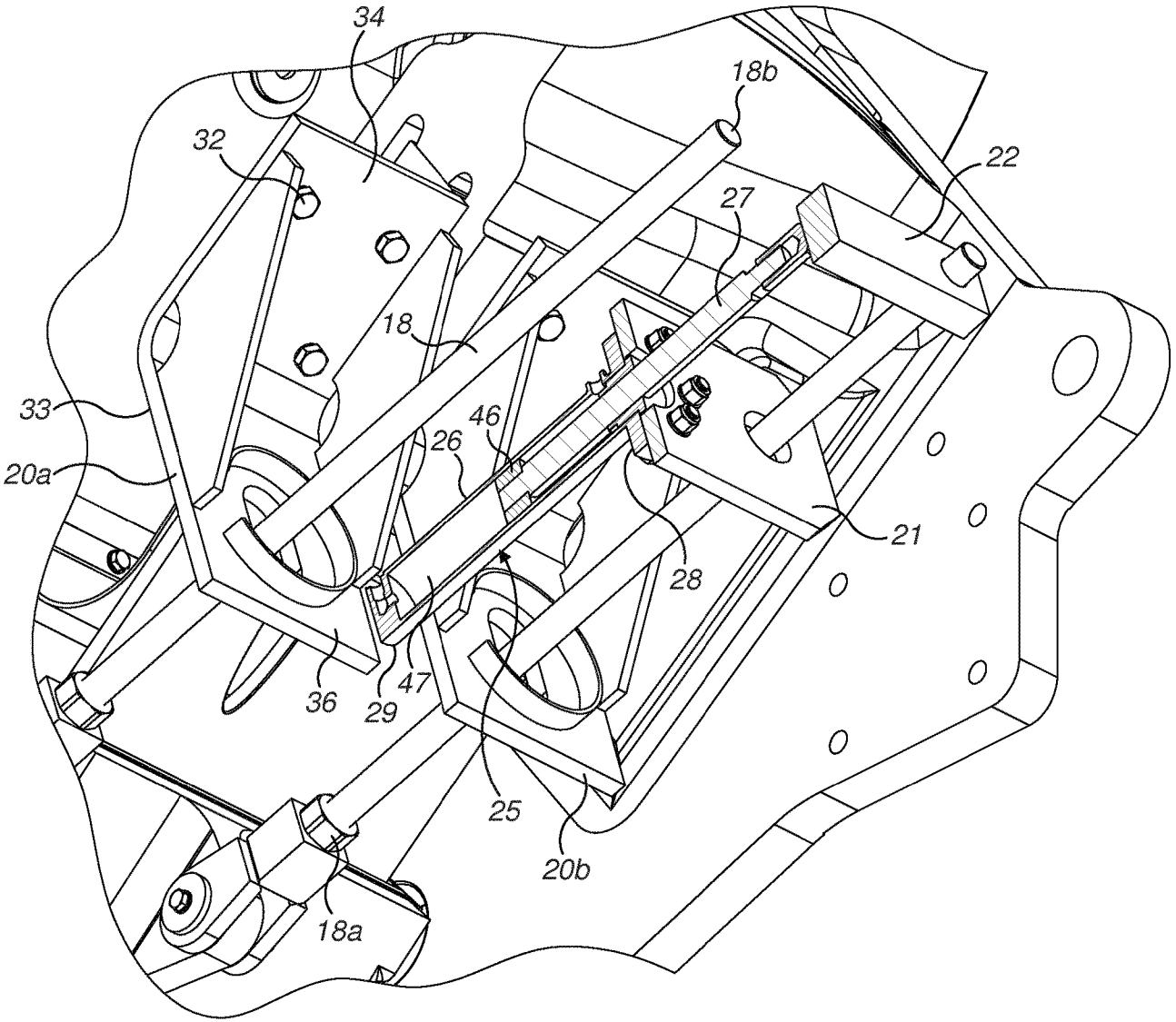
FIG. 4 is a cross sectional perspective view of the retraction assembly of FIG. 3 with selected components removed for illustrative purposes.
Figure 6:
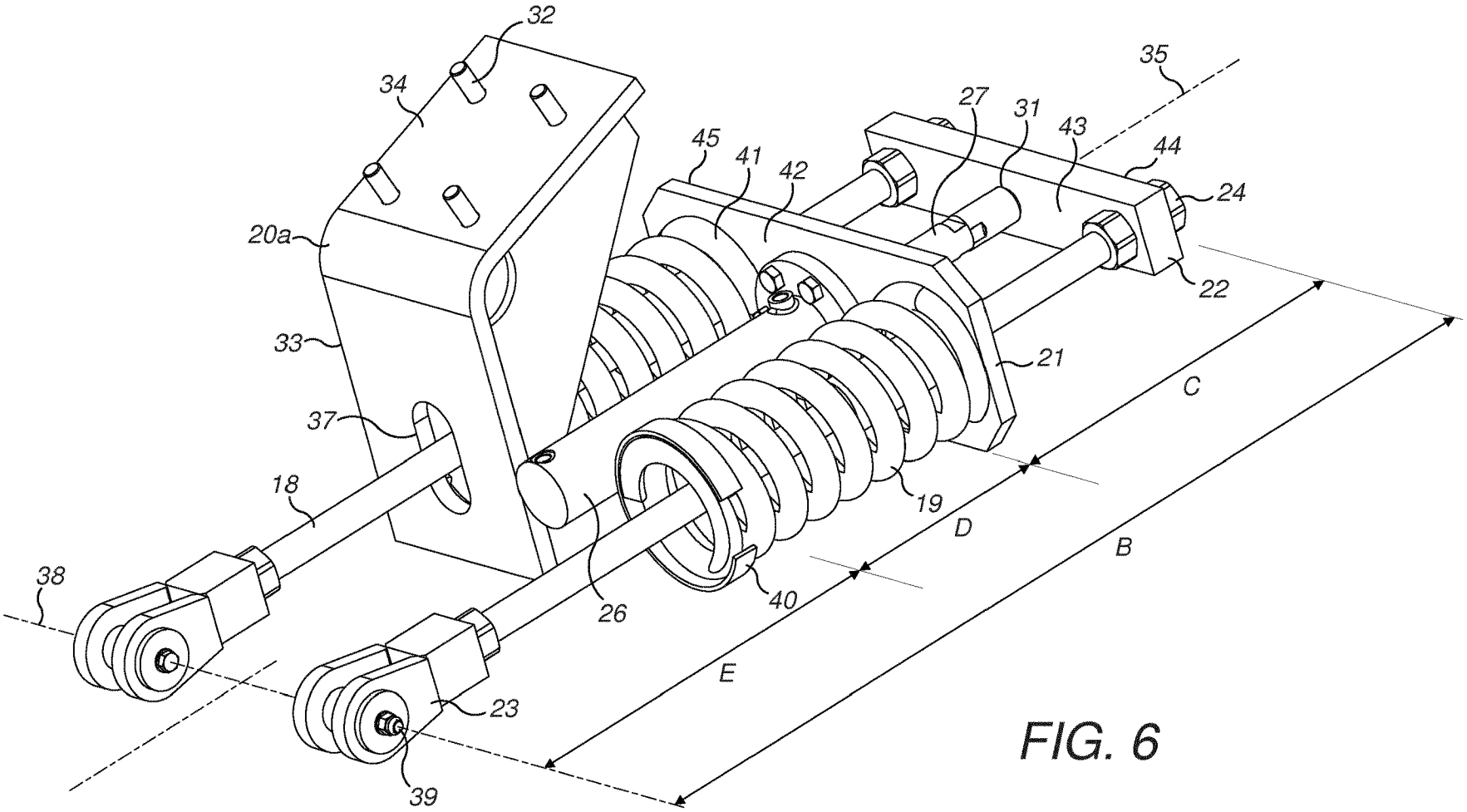
FIG. 6 is a perspective view of the retraction assembly of FIGS. 2 to 5 isolated from the jaw crusher and with selected components removed for illustrative purposes.

Referring to FIGS. 2 and 3, retraction assembly 16 is mounted to a lower region of movable jaw 12 via a set of pivot mountings. The pivot mountings comprise a respective pair of jaw mounting flanges 17 projecting rearwardly from the lower region of movable jaw 12 and a corresponding pair of rod brackets 23 pivotally mounted at each jaw mounting flanges 17. Retraction assembly 16 comprises generally a pair of retraction rods 18 extending longitudinally along axis 35 in a direction rearwardly away from movable jaw 12 below back-frame-end 14. Retraction assembly 16 further comprises a base 20 mountable to a lower region of back-frame-end 14; a hydraulic cylinder 25; a pair of coil springs 19; a first boss 21 and a second boss 22. Referring additionally to FIGS. 4 and 6, base 20 is formed from two equal halves 20*a*, 20*b* with each half independently mounted to the lower region of back-frame-end 14 via a set of mounting bolts 32. Each base half 20*a*, 20*b* comprises a right-angled bracket in which a first flange 33 is aligned transverse and approximately perpendicular to a second flange 34, with second flange 34 bolted to the underside of back-frame-end 14. Accordingly, first flange 33 is aligned approximately perpendicular to longitudinal axis 35. Each flange 33 comprises a generally planar mount face 36 being rearward facing away from movable jaw 12. An elongate aperture 37 extends centrally within flange 33 and is aligned to extend generally in the upward and downward direction of the crusher 10 corresponding to the main length of jaws 11, 12. Retraction assembly 16 comprises a first and second retraction rod 18 each with a respective first rod end 18*a* and second rod end 18*b* configured to extend through each aperture 37 of a respective base half 20*a*, 20*b*. Mount face 36 provides a surface to positionally mount each respective coil spring 19 that extends rearwardly from base 20 towards and in contact with first boss 21. According to the specific implementation, first boss 21 comprises a plate-like structure having a corresponding planar mount face 42 being forward facing towards movable jaw 12 and base mount face 36. An opposed face 45 of first boss 21 is rearward facing towards second boss 22. Each coil spring 19 comprises a first axial end 40 (mounted in abutment contact with base mount face 36) and a second axial end 41 (mounted in abutment contact with first boss mount face 42). Accordingly, each spring 19 is sandwich axially between the opposed mount faces 36, 42 of the respective base 20 and first boss 21. According to this specific implementation, a main length of the elongate aperture 37 within each base flange 33 is approximately equal to an inside diameter of each coil spring 19. Such a configuration allows a degree of upward and downward movement of each retraction rod 18 to accommodate the oscillating motion of jaw 12. Each spring 19 having a helical configuration is positioned to surround a length portion of each respective retraction rod 18. In particular, an inside diameter of each coil spring 19 is appreciably larger than an outside diameter of each retraction rod 18.

Figure 5:
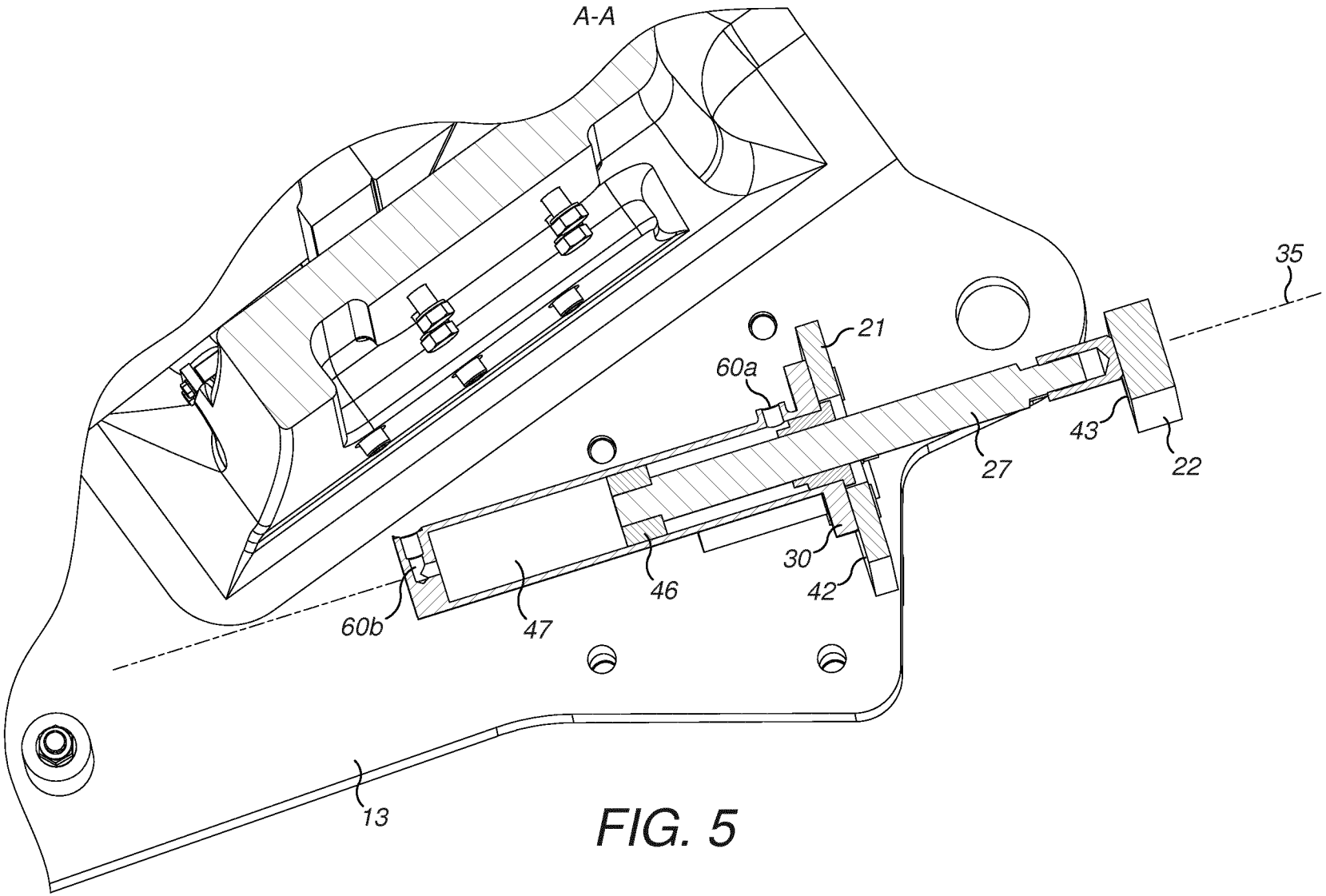
FIG. 5 is a side elevation cross sectional view of part of the retraction assembly of FIG. 4 with selected components removed for illustrative purposes.

Referring again to FIGS. 2 and 3, cylinder 25 according to the specific implementation is a hydraulic mechanical actuator. Referring in part to FIGS. 4 and 5, cylinder 25 comprises a cylindrical elongate barrel 26 that accommodates an internal piston 46 mounted within a piston chamber 47 extending the length of barrel 26. Cylinder rod 27 extends axially from piston 46 such that reciprocating axial movement of piston 46 (within chamber 47) provides a corresponding axial displacement of rod 27 to and from barrel 26. The reciprocating axial motion of piston 46 and rod 27 is controlled by the transfer of fluid to/from the internal chamber 47 via one or a pair of fluid transfer ports 60*a*, 60*b* extending through barrel 26.

Referring again to FIGS. 2 and 3, barrel 26 comprises a first end 28 and a second end 29. According to the specific implementation, barrel 26 is rigidly mounted at first boss 21 and in particular boss mount face 42 via an annular collar 30 secured to first boss 21 via attachment bolts. Barrel second end 29 may be regarded as 'free' and is unsupported or unmounted in cantilever mounting position via barrel first end 28. An axial length of barrel 26 and a corresponding axial length of springs 19 (and a separation distance between base 20 and first boss 21) is such that barrel second end 29 is mounted at a corresponding axial position of base 21, with this second end 29 positioned intermediate between the base halves 20*a*, 20*b* (in the lateral direction perpendicular to axis 35). Additionally, barrel 26 is positioned laterally between the pair of springs 19 that are positioned in side-by-side relationship to extend axially between base 20 and first boss 21. That is, the entire length of barrel 26 extends in a forward direction from boss mount face 42 towards movable jaw 12 and rod brackets 23.

Cylinder rod 27 projects axially from barrel 26 and extends rearwardly from first mount boss 21 towards and in contact with second boss 22. Additionally, retraction rods 18 extend rearwardly from first mount boss 21 towards and in contact with second mount boss 22. Accordingly, first mount boss 21 comprises three respective apertures extending through its plate-like body between the forward and rearward faces 42, 45 so as to accommodate the axial passage of the two retraction rods 18 and the single cylinder rod 27 (extending from cylinder barrel 26). Each retraction rod second end 18*b* is rigidly attached to second boss 22 via a respective bolt 24. Similarly, a second end 31 of cylinder rod 27 is configured to abut in touching contact a planar mount face 43 of second boss 22. Second boss mount face 43 is forward facing towards first boss 21 with a corresponding rear face 44 orientated away from movable jaw 12.

The present retraction assembly 16 is advantageous to minimise stress at the various components of the assembly and in particular the rod brackets 23 that carry the mounting pins 39 to enable retraction assembly 16 to pivot via pivot axis 38 (extending through pins 39) at the lower region of movable jaw 12. The pivoting motion of retraction assembly 16 about axis 38 is stabilised by the inward mounting of cylinder barrel 26 and piston 46 in a direction towards pivot axis 38. In particular, the full axial length of barrel 26, the piston 46 and approximately half of an axial length of cylinder rod 27 are positioned in the forward direction towards moveable jaw 12 from the first boss mount face 42. Accordingly, the longitudinal axial separation (along axis 35) of the mass of these components from the pivot axis 38 is minimised to reduce the torque within the assembly 16 at its mounting position about axis 38. Such a configuration is advantageous as the retraction assembly 16 dynamically pivots about axis 38 due to the oscillating motion of jaw 12 and the crushing action of the jaw crusher 10. Such an arrangement is to be contrasted with conventional mountings in which cylinder 25 is mounted in a reverse configuration with barrel 26 positioned rearward of cylinder rod 27 in a direction from the pivot axis 38. Additionally, the mounting of cylinder 25 between the springs 19 and retraction rods 18 provides a compact design in the lateral sideways direction perpendicular to axis 35. The present arrangement is further advantageous to minimise the total axial length of the assembly 16 along axis 35 by the inward mounting of cylinder 25 from the first boss 21 and in an axial direction between first boss 21 and base 20. Such an arrangement also facilitates the mounting and positioning of fluid supply hoses to barrel 26. That is, as cylinder 25 (and in particular barrel 26) does not oscillate back and forth to a large extent, the present retraction assembly 16 enables shorter hoses to be used which is advantageous for efficient use of material and to reduce the risk of damage or catching of the hoses by personnel, tools or components of the jaw crusher 10.

Additionally, the present configuration in which the cylinder 25 is mounted from the first boss axially closest to the base 20 reduces force loading on the piston 46. Accordingly, it is not necessary to compress springs 19 at a set or rest position that would otherwise be needed for conventional arrangements. Accordingly, the full axial length of springs 19 is available in use to control the oscillating motion of jaw 12.

Referring to FIG. 6 and when the system is at rest (i.e., not under crushing load), second boss 22, that represents a rearwardmost part of the retraction assembly 16, is separated from pivot axis 38 by distance B. Base flange 33 is separated from pivot axis 38 by a distance E. This distance E also corresponds to the axial separation from pivot axis 38 of the second end 29 of barrel 26 and first end 40 of springs 19. First boss 21 is separated from base flange 33 by a distance D. This distance D also corresponds to the axial length of springs 19 and cylinder barrel 26. Second boss 22 is separated axially from first boss 21 by a distance C. This distance C corresponds approximately to half an axial length of cylinder rod 27 with a second half of the rod 27 extending within barrel 26. According to the specific implementation, the quotient of C/D is in a range 0.6 to 1.0; D/E is in a range 0.6 to 1.0; E/B is in a range 0.1 to 0.4; D/B is in a range 0.1 to 0.6; and C/B is in a range 0.1 to 0.4. Preferably, the separation of the second boss 22 from the first boss 21 is approximately equal and slightly less than a corresponding axial separation of the first boss 21 from the pivot axis 38. This relationship also corresponds to the relative axial length of the barrel 26, springs 19 and exposed portion of the cylinder rod 27 that extends between the first and second boss 21, 22. Naturally all axial dimensions C, D and E are subject to change when the crusher is operational and the system is moving dynamically.

As will be appreciated, the force transmission pathway from movable jaw 12 extends axially rearward along each retraction rod 18 to second boss 22. The force is then transmitted in the return forward direction along cylinder rod 27 into piston 46 and barrel 26. The force is then transmitted from barrel 26 to first boss 21 and into springs 19. Finally, the force transfers from springs 19 into base 20 and is accordingly distributed into the back-frame-end 14 via the respective base flanges 33 and in particular flange 34.

The invention claimed is:

1. A jaw crusher retraction assembly comprising:

a base mountable to a frame part of a jaw crusher;

a first boss separated from the base and a second boss separated from the first boss, the second boss positioned furthest from a movable jaw of the jaw crusher relative to the first boss and the base;

at least one resiliently biased component mounted to extend between and arranged to resiliently of separate the first boss and the base;

a first and second retraction rod each having first and second ends, the first and second rods being mounted at the respective first ends to the second boss and extending past the first boss and the base for attachment at each of the respective second ends to the movable jaw; and a cylinder having a barrel, a cylinder rod and a piston mounted to couple and act between the first boss and second boss, wherein the barrel is mounted to extend from the first boss in a direction towards the base and one end of the cylinder rod is positioned at the second boss such that the cylinder rod extends from the barrel and between the first boss and the second boss.

2. The assembly as claimed in claim 1, wherein the at least one resiliently biased component is at least one spring.

3. The assembly as claimed in claim 2, wherein the at least one resiliently biased component is a pair of springs each spring extending between the base and the first boss.

4. The assembly as claimed in claim 3, wherein each of the springs of the pair of springs is a coil spring that extends respectively around a portion of the length of the respective first and second retraction rods.

5. The assembly as claimed in claim 4, wherein the coil springs are positioned side-by-side and the barrel is mounted at the first boss to be positioned laterally between the coil springs.

6. The assembly as claimed in claim 4, wherein an axial length of the coil springs is approximately equal to an axial length of the barrel.

7. The assembly as claimed in claim 1, wherein each of the first and second boss is a plate.

8. The assembly as claimed in claim 7, wherein the first boss includes first boss apertures and the first and second retraction rods pass respectively through the first boss apertures.

9. The assembly as claimed in claim 1, wherein the base includes base apertures, the first and second retraction rods passing respectively through the base apertures.

10. The assembly as claimed in claim 1, wherein the barrel includes a first and a second end, the cylinder being mounted at the first boss at the first end of the barrel.

11. The assembly as claimed in claim 1, wherein substantially a full length of the barrel extends from one side of the first boss.

12. The assembly as claimed in claim 1, wherein substantially a full length of the cylinder rod extends from one side of the second boss.

13. A jaw crusher comprising:

a first jaw and a second movable jaw; and a jaw mounting assembly arranged to enable the second movable jaw to oscillate back and forth relative to the first jaw, wherein the jaw mounting assembly includes a jaw crusher retraction assembly comprising: a base mountable to a frame part of a jaw crusher; a first boss separated from the base and a second boss separated from the first boss, the second boss positioned furthest from the second movable jaw of the jaw crusher relative to the first boss and the base; at least one resiliently biased component mounted to extend between and arranged to resiliently separate the first boss and the base; a first and second retraction rod each having first and second ends, the first and second rods being mounted at respective first ends to the second boss and extending past the first boss and the base for attachment at each respective second ends to the movable jaw; and a cylinder having a barrel, a cylinder rod and a piston mounted to couple and act between the first boss and second boss, wherein the barrel is mounted to extend from the first boss in a direction towards the base and one end of the cylinder rod is positioned at the second boss such that the cylinder rod extends from the barrel and between the first boss and the second boss.

14. The crusher as claimed in claim 13, wherein the jaw mounting assembly includes a back-frame-end, the base of the jaw crusher retraction assembly being mounted to an underside region of the back-frame-end.

* * * * *